United States Patent [19]

Matsuoka

[11] 4,064,732

[45] Dec. 27, 1977

[54] COIL ACTUATING APPARATUS IN A COIL SPRING MAKING MACHINE

[76] Inventor: Takeji Matsuoka, No. 2-703, 26, 3-chome, Ohjima, Kohto, Tokyo, Japan

[21] Appl. No.: 721,231

[22] Filed: Sept. 8, 1976

[51] Int. Cl.[2] ..... B21F 3/04

[52] U.S. Cl. ..... 72/449; 72/142

[58] Field of Search ..... 72/135, 142, 143, 130, 72/131, 449; 140/83, 92, 102, 105; 74/23, 24, 29, 30, 32, 33, 40, 46, 53, 447, 22 R

[56] References Cited

U.S. PATENT DOCUMENTS

| | | | |
|---|---|---|---|
| 2,120,146 | 6/1938 | Halvorsen et al. | 72/142 |
| 2,163,019 | 6/1939 | Blount et al. | 72/142 |
| 2,765,022 | 10/1956 | Bergevin | 72/131 |
| 2,806,507 | 9/1957 | Stofko | 72/142 |
| 3,090,641 | 5/1963 | Eminger | 74/23 |
| 3,651,708 | 3/1972 | Müller | 74/447 |

*Primary Examiner*—Michael J. Keenan

*Attorney, Agent, or Firm*—Stevens, Davis, Miller & Mosher

[57] ABSTRACT

A coil actuating apparatus in a coil spring making machine in which uniform coil springs are manufactured by alternately actuating reciprocating movement of a rack and stoppage of such movement for a predetermined period of time by rotation of a main cam through reciprocating rotation of a crank arm.

2 Claims, 6 Drawing Figures

COIL ACTUATING APPARATUS IN A COIL SPRING MAKING MACHINE

DESCRIPTION OF THE PRIOR ART

In conventional coil spring making machines, wherein a rack is reciprocated by a crank driven by a prime mover to effect rotation and stoppage of a winding shaft in association therewith, a stoppage period of the winding shaft succeeded by winding completion time of the winding shaft corresponding to a dead center position of the crank is momentary, and hence there is no time for forming legs of coil springs. In an effort to solve such a drawback there has been proposed, for example, a mechanism as shown in FIG. 1. In the arrangement FIG. 1, butt members 43, 43 are suitably secured to a connecting rod 42 movably connected to a crank arm 41 driven by a prime mover (not shown). The connecting rod 42 extends through and is loosely recieved within a holding member 44, which is retained on a support shaft 45 later described. Along with the butt members 43, 43 and a predetermined clearance (*f*), a rack 46 is formed integral with support member (*h*) for supporting support shaft 45 extending through and secured to the holding member 44. A winding shaft is associatably disposed relative to a pinion 47 meshed with the rack 46 through a train of gearings, a linkage mechanism and the like not shown, whereby when crank arm 41 is rotated to draw the connecting rod 42, the rack 46 remains stationary at a predetermined position until either of the butting members 43, 43 butts against the holding member 44 to cause the winding shaft not shown to stop for a predetermined period of time, during which time, arms of coil springs may be processed. (It will be noted that some devices are designed so that a driving shaft extending through and secured to a driving gear meshed with the winding shaft is stopped for a predetermined period of time, but such devices are identical in principle in that the winding shaft is stopped for a predetermined period of time.) In this case, however, the rack 46 is rapidly moved after the crank arm 41 has moved far from the dead center, and accordingly, rapid acceleration is produced in the winding shaft at the beginning of rotation, as a consequence of which a slip occurs between the winding shaft and a point where a wire material is wound thereabout. For this reason, the length of the first legs of the coil springs manufactured is different from one another every time they are made, resulting in "irregularity" in length. This makes it quite impossible to manufacture uniform products. Even if the speed of the winding shaft at the beginning of rotation is slowed down, products barely may be unified. On the other hand, however, enhancement of production efficiency in making coil springs is lacking under the condition of low speed of the winding shaft. This aspect renders it quite impossible to put good and inexpensive products on the market. In addition, prior art devices further involve a disadvantage in that there is a possibility of not being able to process legs of coil springs when the latter intersect with each other or depending on the arrangement of a forming machine.

SUMMARY OF THE INVENTION

In accordance with a first feature of this invention, coil springs are manufactured by alternately actuating reciprocating motion of a rack and stoppage of such a motion for a predetermined period of time by rotation of a main cam through reciprocating rotation of a crank arm.

In accordance with a second feature of this invention, there is provided an arrangement wherein a rack is reciprocated by rotation of a main cam through reciprocating rotation of a crank arm, a setting position of the crank arm relative to the rack being adjusted by means of a fastening member.

It is a primary object of this invention to provide a coil actuating apparatus in a coil spring making machine which can manufacture coil springs uniformly and of good quality by taking a sufficient period of time to form and process the wire material without rapid increase or decreases in speed of the winding shaft.

It is another object of this invention to provide a coil actuating apparatus in a coil spring making machine which can form legs even when the latter intersect with each other at the time of winding by suitably selecting the setting position of the crank arm.

It is a further object of this invention to provide a coil actuating apparatus in a coil spring making machine which can avoid a useless complication of a construction or mechanism for making products.

DETAILED DESCRIPTION OF THE INVENTION

Figure 1:
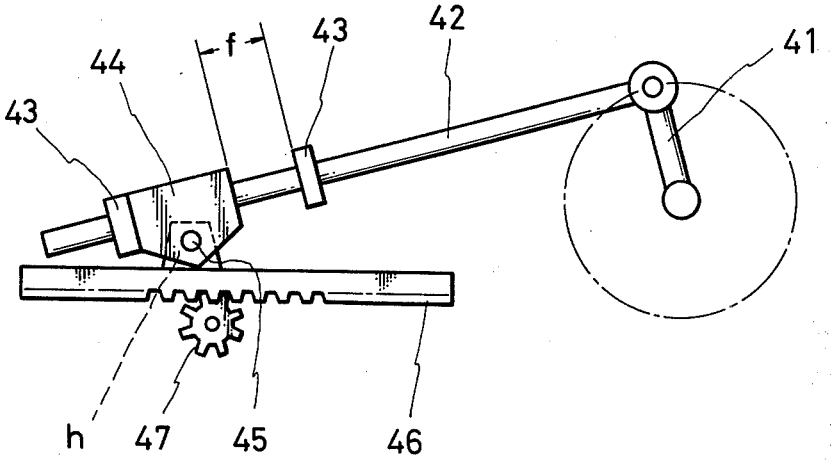
FIG. 1 PRIOR ART
FIG. 1 illustrates an essential part of a conventional coiling actuating apparatus showing a mode in which a crank arm is associated with a rack.
Figure 2:
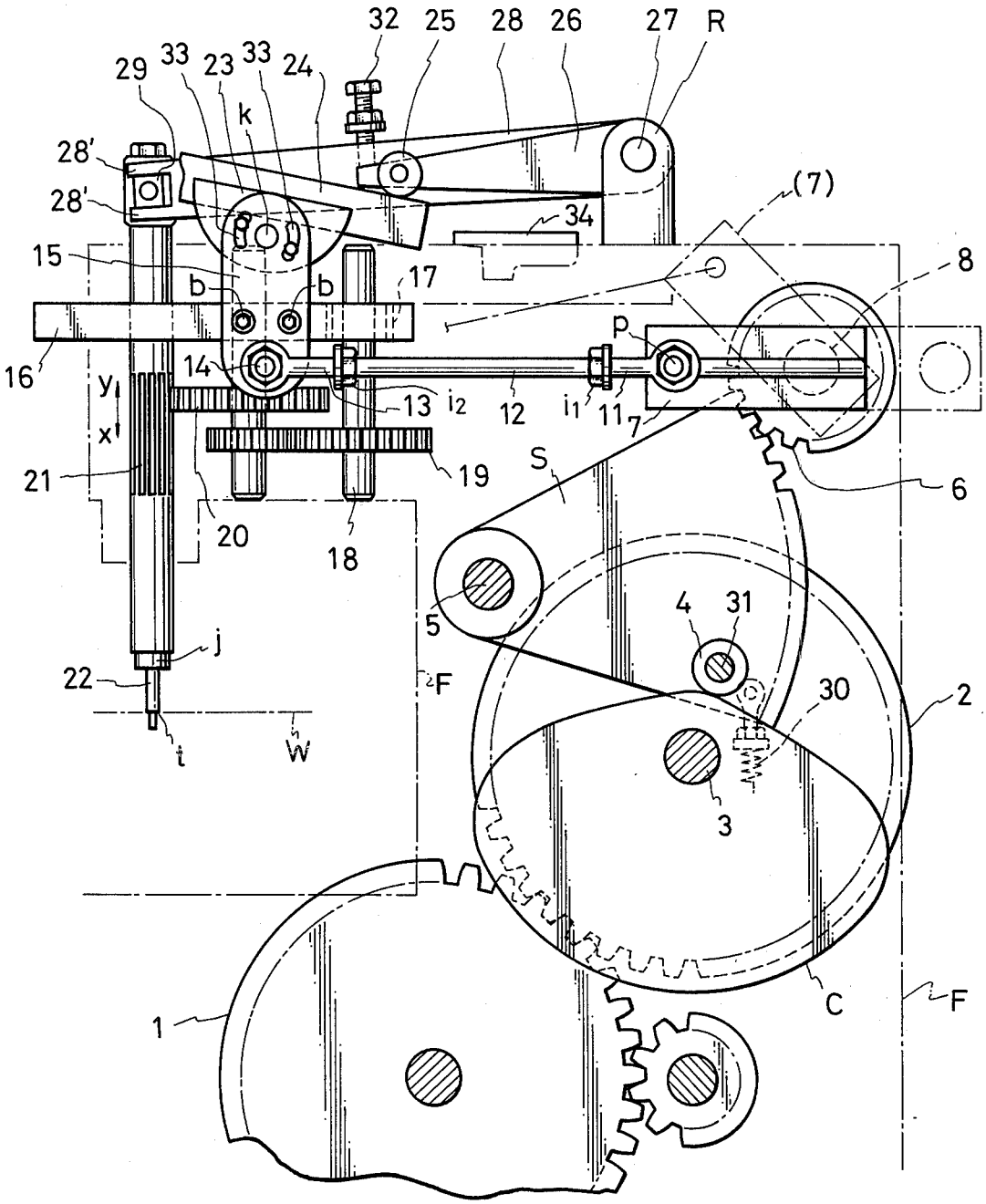
FIG. 2 is a sectional view of an essential part of one embodiment in accordance with the present invention.
Figure 3:
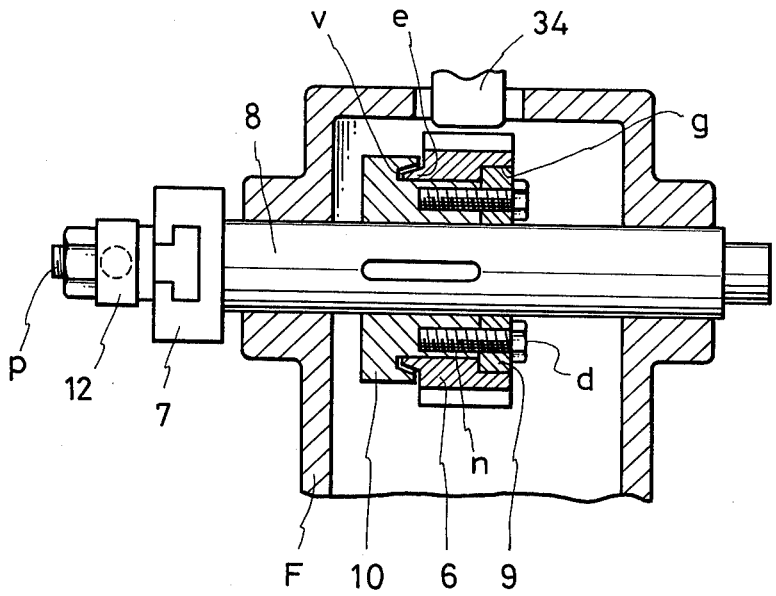
FIG. 3 is a side view of an essential part of the embodiment of FIG. 2.
Figure 4:
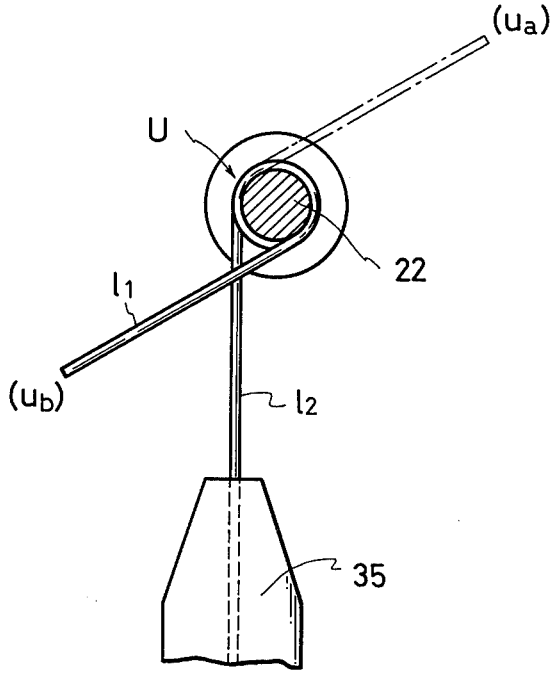
FIG. 4 is a front view showing a mode of processing a coil spring of which legs intersect.
Figure 5:
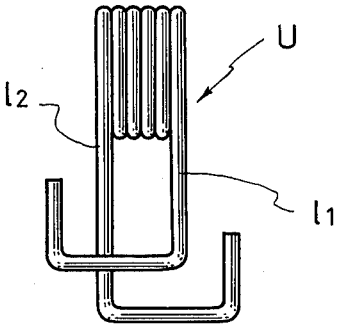
FIG. 5 is a side view thereof.
Figure 6:
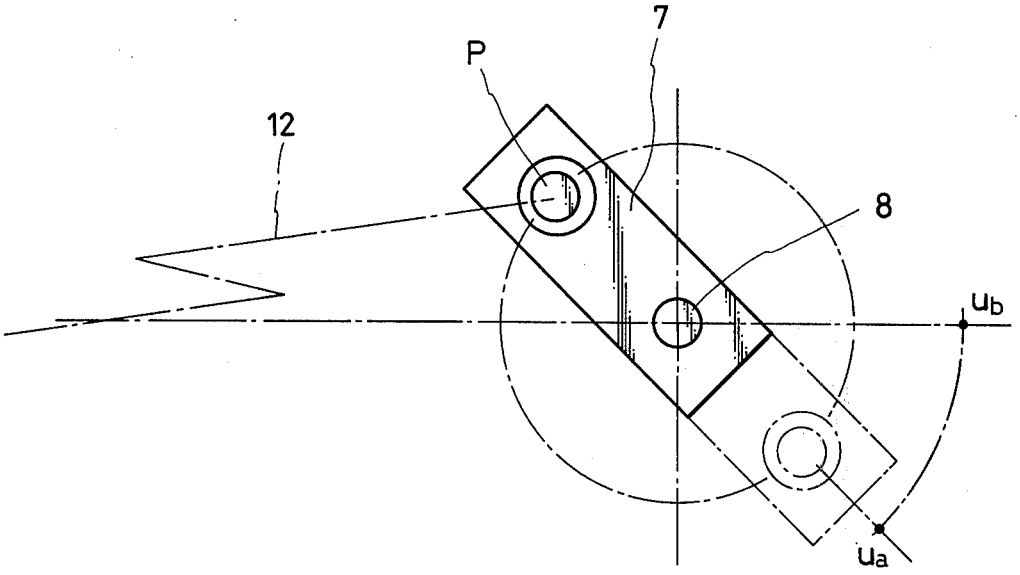
FIG. 6 illustrates a rotative position of the crank arm corresponding to the processing position of the spring of FIG. 5.

An embodiment of this invention will now be described with reference to FIGS. 2 through 6. A gear 1 driven by means of an electric motor not shown causes a coil spring processing member, for example, such as a wire cutter and a leg forming device (both not shown), to actuate through suitable gear train, rotative shafts and operating rods. On a cam shaft 3 provided with a gear 2 meshed with the gear 1 are fixed in parallel a wire feeding cam, a cam for actuating other necessary members and a main cam (C). A cam follower 4, which always comes in contact with an outer peripheral edge of the main cam (C), is rotatably supported on a support shaft 31 planted on one side of a quadrant gear (S) of which root is secured to a support shaft 5 rotatably supported on a machine frame (F). A driven gear 6 with a protrusion (*e*) meshed with the quadrant gear (S) is formed integral with a support shaft 8 of a crank arm 7 by means of a fastening member 9, which will be described hereinafter. One side of a disc 10 keyed to the support shaft 8 is formed with a concave (*v*), and the fastening member 9 is closely fitted into a notch (*g*) cut in the driven gear 6 formed with the protrusion (*e*), which is brought into engagement with the concave (*v*). A tap bolt (*d*) is extended through the fastening member 9 and disc 10, the tap bolt (*d*) being screwed into internal threads (*n*) built into the disc 10 thereby forming driven gear 6, crank arm 7, the support shaft 8, fastening member 9 and disc 10 into an integral structure. Thus, a desired angle of the crank arm 7 to the driven gear 6 may readily be made by untightening the tap bolt (*d*) to put the fastening member 9 in a loose fit relation with respect to the disc 10. A circular expanded portion of a connecting member 11 is loosely fitted on a crank pin (*p*) movably connected to a position control mechanism (a stroke control mechanism) mounted on the crank arm 7, on the opposite side of which one end of a connecting rod 12 (at the righthand in FIG. 2) is tightened by means of a metal holder ($i_1$) such as a nut while the other end of the connecting rod (at the left-hand in FIG. 2) being tightened to a connecting member 13 of the same configuration as that of the connecting member 11 by means of a metal holder ($i_2$). An elliptical connection 15 is secured to a support shaft loosely fitted in the circular inflated portion of the connecting member 13, and a rack 16 is fastened by means of set-screws (*b*) passed through the connection 15. A gear 19 is secured to a rotative shaft 18 on which a pinion 17 meshed with the rack 16 is supported, and a gear 20 is driven through a gear train (not shown) composed of a suitable number of gears in association with the gear 19. A winding shaft 22 is secured through a chuck (*j*) to the lower end of a spindle gear 21 meshed with the gear 20 so that a wire (W) as a coil spring blank may butt against the stepped portion (*t*) at the lower end of the winding shaft 22. An elongated butt member 24 is fixedly secured to a semicircular mounting plate 23 of which center is secured by means of a pin (*k*) to the connection 15, and a support shaft 27 is secured to a root (R) (at the right end in FIG. 2) of an oscillator 26, at the end of which a roller 25, always in contact with the butt member 24, is rotatably supported. A square retainer 29, which is rotatably supported in the neighbourhood of the upper end of the spindle gear 21, is retained between a pair of fork members 28', 28' located at the end of another oscillator 28 whose root is secured to the support shaft 27, so that the spindle gear 21 may be moved in the direction of $x - y$ as indicated by the arrow. A return spring 30 of which one end is secured to the quadrant gear S is provided to always urge the gear (S) towards the main cam (C). A repression member 32 fixed in the midst of the oscillator 28 is provided to repress unnecessary oscillation of the oscillators 26 and 28, and on the other hand, an adjusting hole 33 made in the connection 15 may serve to set (as indicated by the dash-dotted contour lines in FIG. 2) the crank arm 7 to the right dead center. In FIG. 2, 34 indicates a stop member which prevents over-running of the quadrant gear (S), and 35 in FIG. 3 indicates a wire guide.

In the construction of the present invention as mentioned above, in the case where the crank arm 7 is in the solid line position in FIG. 2 to form a coil spring (U), electric motor is started to drive gear 1, and when cam shaft 3 is rotated counterclockwise in FIG. 2 through gear 2 meshed with gear 1, main cam (C) is also rotated counterclockwise simultaneously therewith to push-up cam follower 4 and as a consequence quadrant gear (S) is also rotated and moved up counterclockwise to thereby cause driven gear 6 meshed therewith to rotate clockwise, and crank arm 7 integral therewith also to rotate in the same direction. Then, connecting rod 12 connected to crank arm 7 is gradually drawn rightwards, and rack 16 connected to rod 12 through connection 15 moves rightwards, as a consequence of which pinion 17 rotates counterclockwise. Gear 20 is then rotated clockwise (in the left winding direction) through the gear train to start winding the wire round winding shaft 22. At the same time, oscillator 26 is rotated clockwise through roller 25 as butt member 24 integral with connection 15 moves rightwards so that both support shaft 27 and oscillator 28 rotate in the same direction to move upwardly (FIG. 2). Spindle gear 21 by fork members 28', 28' at the end of oscillator 28 through retainer 29, thus gradually winds wire W into the desired number of turns. When main cam (C) is rotated through a predetermined angle (120° in the illustrated embodiment) and crank arm 7 reaches the right-hand dead center (as indicated by the dash-dotted contour lines in FIG. 2), the cam follower 4 merely rotates for a predetermined distance because the curve formed by the main cam (C) is a circular arc depicted through a predetermined radius, and quadrant gear (S) itself will not rotate. Accordingly, crank arm 7 remains still when main cam (C) is rotated through a predetermined angle (90° in the illustrated embodiment), resulting in winding shaft 22 also remaining still during that time. The end portion of a coil spring wound about winding shaft 22 during that time may be cut into the desired length or the aforesaid end portion undergoes a forming process such as bending it into a desired form. Then, when main cam (C) is rotated further counterclockwise, cam follower 4 starts to move down and quadrant gear (S) is rotated clockwise by the downward force of return spring 30 so that crank arm 7 rotates counterclockwise from the right-hand dead center. As a consequence, rack 16 moves towards the left and causes the spindle gear 21 to reverse and its rotational direction oscillator 28 to oscillate in the counterclockwise direction causing it to move downwardly to rewind the wire W already formed. The wire W is then disengaged from the winding shaft 22 by its own springback force to obtain a desired coil spring (U). On the other hand, when the main cam (C) is rotated through a predetermined angle (120° in the illustrated embodiment) and the crank arm 7 returns to the left-hand dead center (as indicated by the solid line in FIG. 2), the outer peripheral edge of the main cam forms a circular arc depicted through a predetermined radius so that quadrant gear (S) itself will not rotate through cam follower 4. Thus, when the cam is rotated through a predetermined angle (30° in the illustrated embodiment), crank arm 7 stays still and so does winding shaft 22, during that period a new wire W to be processed in the successive step is fed. Thereafter, main cam (C) is rotated to assume its initial state, thus restarting winding of wire W round winding shaft 22. Upon completion of one cycle composed of four steps, winding, stopping, rewinding and stopping, as described above, the state shown in FIG. 2 is assumed again. In this manner, coil springs of desired form are continuously manufactured by repeated operation of such a cycle as noted above. In the case of winding in the opposite direction (rightward winding in this case), fastening member 9 may be untightened to set crank arm 7 to the opposite side by 180° (as indicated by the dash-dotted contour lines in FIG. 2). It will be noted that the stroke of rack 16 may be varied by the position control mechanism of crank pin (*p*), whereby the number of turns of coil spring (U) may suitably be selected. In the case of a forming process for a coil spring of which legs $l_1$, $l_2$ intersect with each other at the time of winding as may be seen in FIGS. 4 and 5, crank arm 7 may be set to the position as indicated by the phantom outline or obliquely. In this case, since crank arm 7 is always rotatably reciprocated through approximately 180° , the arm will stop at the position where it passes the right-hand dead center in the step of winding, and hence, rack 16 will also stop at the position where it returns slightly leftwards from the right end, as a consequence of which winding shaft 22 after completion of winding will stop at the position where it is slightly rewound. Accordingly, in FIG. 4, the wire is once wound to the position as indicated at ($u_b$) and is then promptly returned to the position as indicated at ($u_a$) by the broken lines, to be held at a convenient position in terms of arrangement of a tool not shown (suitably determined at a position of crank angle). This results in a conspicuous increase in the number of legs processed as compared to that of prior art devices. After completion of the forming process, the first leg $l_1$ tends again to return to the position indicated at ($u_b$) from the position indicated at ($u_a$) as a result of rotation of the crank arm 7 counterclockwise. Since the second leg $l_2$ also has been cut by the forming process simultaneously with the first leg $l_1$, the tool may suitably be released to thereby displace the second leg $l_2$ clockwise in FIG. 4 with the aid of spring-back of the coil itself so as to prevent the second leg from coming in contact with the first leg $l_1$ even if the latter assumes the position indicated at ($u_b$). Thus, the first leg $l_1$ reaching the position indicated at ($u_b$) is rewound as crank arm 7 successively rotates counterclockwise, and is disengaged from winding shaft 22 with the aid of spring back of the coil itself.

In accordance with the present invention, rotative motion of the main cam driven by the prime mover is transmitted to the crank arm, and such rotative motion through approximately 180° is converted by the crank arm through a rack into reciprocating rotative motion. From this, the rising curve of the cam is superposed on the rising curve of the crank arm from the dead center to prevent the winding shaft from its rapid accelerating rotation at the time of winding thereby providing reasonable winding of wires. Thereafter, the wire is wound under the prompt and substantially uniform conditions and is then quickly rewound to produce coil springs. Accordingly, the apparatus of the invention may afford coil springs of better quality than those obtained by conventional coil spring making machines. In additiona, the winding period of the winding shaft, the stopping period of winding, the rewinding period and the stopping period of the beginning winding may conveniently be controlled by the outer peripheral edge contour of the main cam in an extremely simple and positive manner. In the arrangement of the invention, even if the outer peripheral edge of the main cam should wane in accuracy of its true circularity, a stopping angle of the crank arm at its pivotal point would merely be displaced to some extent, hardly affecting the stopping position of the rack, so that articles of uniform quality may be secured. Further according to the present invention, the crank arm is merely disposed for reciprocating motion between the main cam and the rack so that the coiling driving mechanism is not so complicated as in that employed in the prior art devices.

Moreover, a forming process for coil springs in which legs intersect with each other at the time of winding, which has been impossible in the prior art, may easily be achieved in the present invention by employment of a very simple procedure in which the crank arm is set in an oblique position, whereby the number of coil springs processed may materially be increased as compared to that of the prior art devices. In addition, a rapid acceleration is produced at the beginning of the winding in the prior art devices whereas in the present invention, the crank arm is operated by the main cam to thereby avoid producing such a rapid acceleration while aided by the rising curve of the cam. Thus the invention is capable of providing a smooth winding operation and of maintaining high speed processes even in processing coil springs of which legs intersect with each other.

What is claimed is:

1. A coil actuating apparatus in a coil spring making machine, comprising a frame, a main cam secured to a cam shaft mounted on said frame, means to drive said cam mounted on said frame, a quadrant gear pivotally mounted on said frame carrying a cam follower in contact with an outer peripheral edge of said main cam, a return spring of which one end is secured to a lower portion of said quadrant gear, a driven gear meshing with an upper portion of said quadrant gear, a fastening member, a disc integral with said fastening member fixed to said driven gear, a first support shaft extending through and fixed in the center of said disc, a crank arm secured to one end of said support shaft, a connecting member pivotally connected at one end to said crank arm through a crank pin, a connecting rod connected at one end to the other end of connecting member, a further connecting member secured to the other end of said connecting rod, a connection pivotally secured to said second connecting member, a rack secured to a lower portion of said connection, a pinion supporting a gear meshed with said rack, and a spindle gear carrying a winding shaft meshed with said gear, a setting position of said crank arm in relation to said driven gear being adjustable.

2. A coil actuating apparatus in a coil spring making machine of claim 1, wherein said driven gear has a protrusion and a notch cut therein, said fastening member closely fitting into said notch, said disc being formed with a concavity into which the protrusion of said driven gear is engaged and including a tap bolt for removably holding said disc and said fastening member together, a semi-circular mounting plate secured to said connection, a member fastened to said semi-circular mounting plate having an upper surface, a roller rotatably disposed on said upper surface of said member, a second support shaft mounted on said machine, a first oscillator carrying said roller and pivotally mounted on said second support shaft, a second oscillator pivotally mounted on said second support shaft in parallel with said first oscillator, and a square retainer mounted on said spindle gear and retained between a pair of fork members forming an end to said second oscillator, said spindle gear being movable with said square retainer.

* * * * *